US006398618B1

(12) United States Patent
Wu

(10) Patent No.: US 6,398,618 B1
(45) Date of Patent: Jun. 4, 2002

(54) MOTORIZED TRANSMISSION FOR IMPARTING MOTION TO A DISPLAY

(76) Inventor: Wen-Long Wu, No. 5, Alley 26, Lane 62, Tung-Hsing Rd., Ta-Li City, Taichung Hsien (TW)

( * ) Notice: Subject to any disclaimer, the term of this patent is extended or adjusted under 35 U.S.C. 154(b) by 0 days.

(21) Appl. No.: 10/022,200

(22) Filed: Dec. 20, 2001

(51) Int. Cl.[7] ..... A63H 11/00; A63H 13/00; A63H 3/20

(52) U.S. Cl. ..... 446/330; 446/353; 446/303; 446/298; 446/358; 446/265; 446/267; 446/309; 446/365; 446/236; 40/411; 40/414; 40/415; 40/418; 40/419; 40/426; 40/455; 84/94.1; 84/95.1; 84/95.2; 74/48; 74/49; 74/89.17; 369/69

(58) Field of Search ..... 446/330, 353, 446/230, 232, 457, 462, 440, 470, 303, 365, 268; 40/426, 414, 418, 420, 419, 411

(56) References Cited

U.S. PATENT DOCUMENTS 4,673,371 A 6/1987 Furukawa
4,801,285 A 1/1989 Yeu
5,870,843 A 2/1999 Hsu et al.

FOREIGN PATENT DOCUMENTS

GB 2154890 A 9/1985

*Primary Examiner*—Derris H. Banks
*Assistant Examiner*—Ali Abdelwahed
(74) *Attorney, Agent, or Firm*—Bacon & Thomas, PLLC

(57) ABSTRACT

A toy consists of a base, a cap and a toy model. The base has stationary wheels and a movable wheel located on the bottom section thereof. The movable wheel may be driven through a gear set by battery power for moving the base around. The cap has a hollow casing located on the top section to house a motor that is driven by a battery for rotating the cap through another gear set. The base has an arched gear rack located on the top surface. By way of an elastic element and a lever to couple with the gear sets and arched gear rack, the cap may be moved to the left and right, and rotated positively and reversely to generate a wide variety of simulative motions.

3 Claims, 7 Drawing Sheets

MOTORIZED TRANSMISSION FOR IMPARTING MOTION TO A DISPLAY

FIELD OF THE INVENTION

The present invention relates to a toy and particularly an electric toy that is capable of moving around and simulating a real object to ride or rotate in various directions and angles.

BACKGROUND OF THE INVENTION

There are numerous electric toys on the market that are mostly driven by motors to move around, such as toy cars, or air planes or helicopters with rotating propellers. Their motions usually have little variation. Their appealing mainly depends on the toy shape and form. Because of lack of unique motion features, they tend to lose attractiveness and appealing to consumers after a short period of time. For a toy to be successful on the market, it is essential to have novel and versatile features and designs.

SUMMARY OF THE INVENTION

The primary object of the invention is to provide a toy that is electrically driven and capable of moving around, and also can simulate a real object to ride or rotate in various directions and angles to create versatile changing effects.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1A:
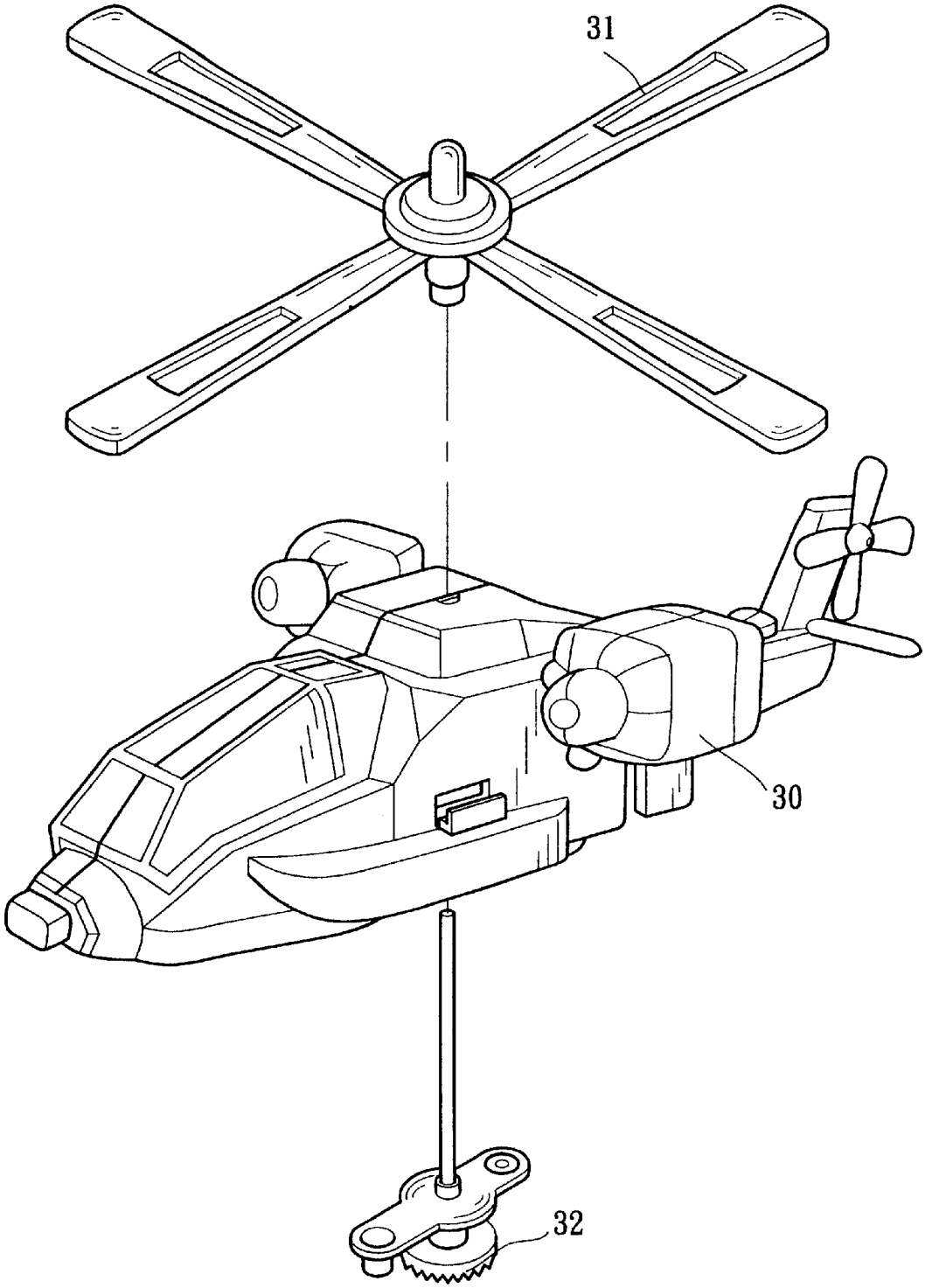
FIG. 1A is an exploded view of an embodiment of the invention.
Figure 1B:
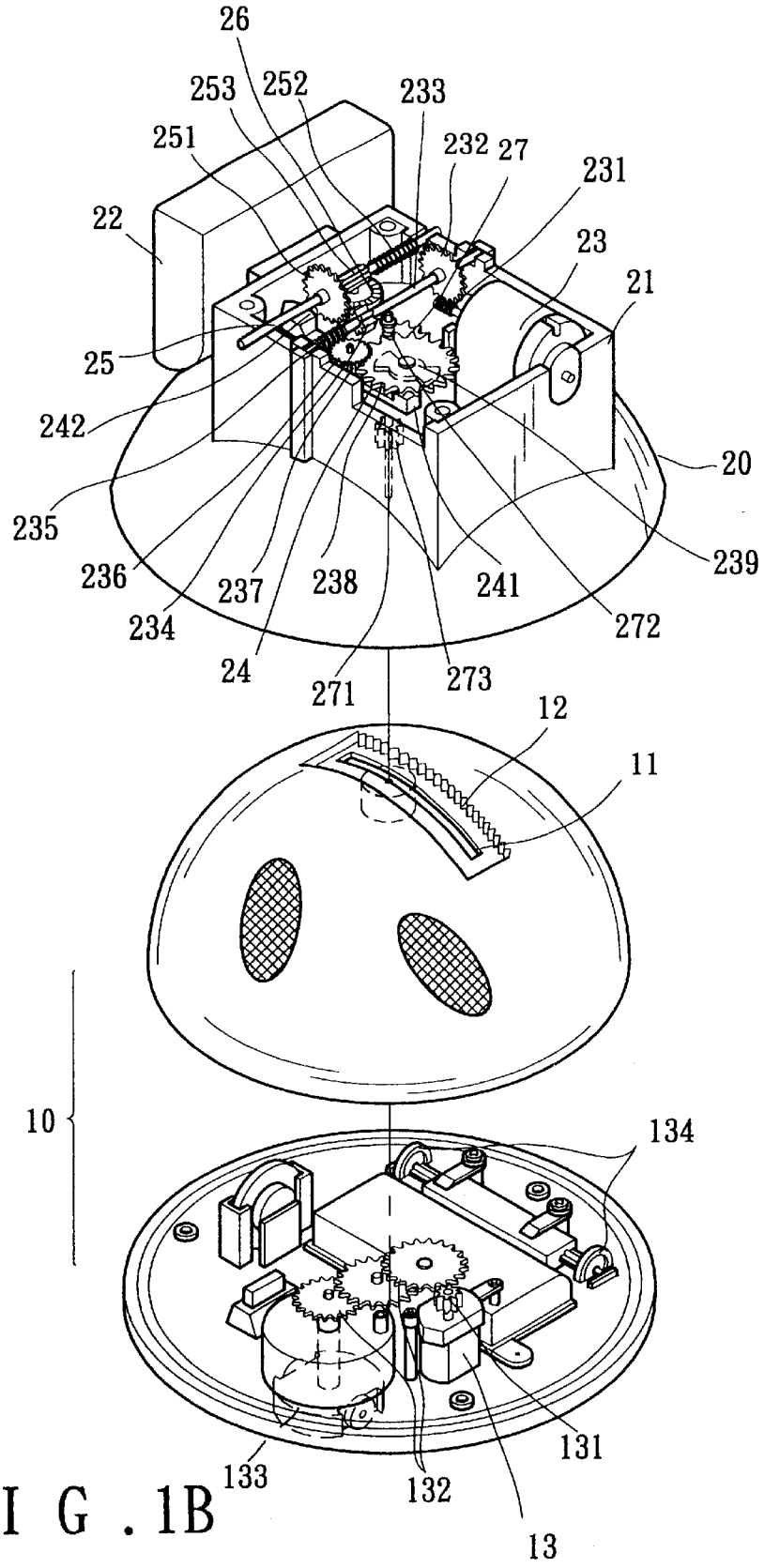
FIG. 1B is another exploded view of an embodiment of the invention.
Figure 2A:
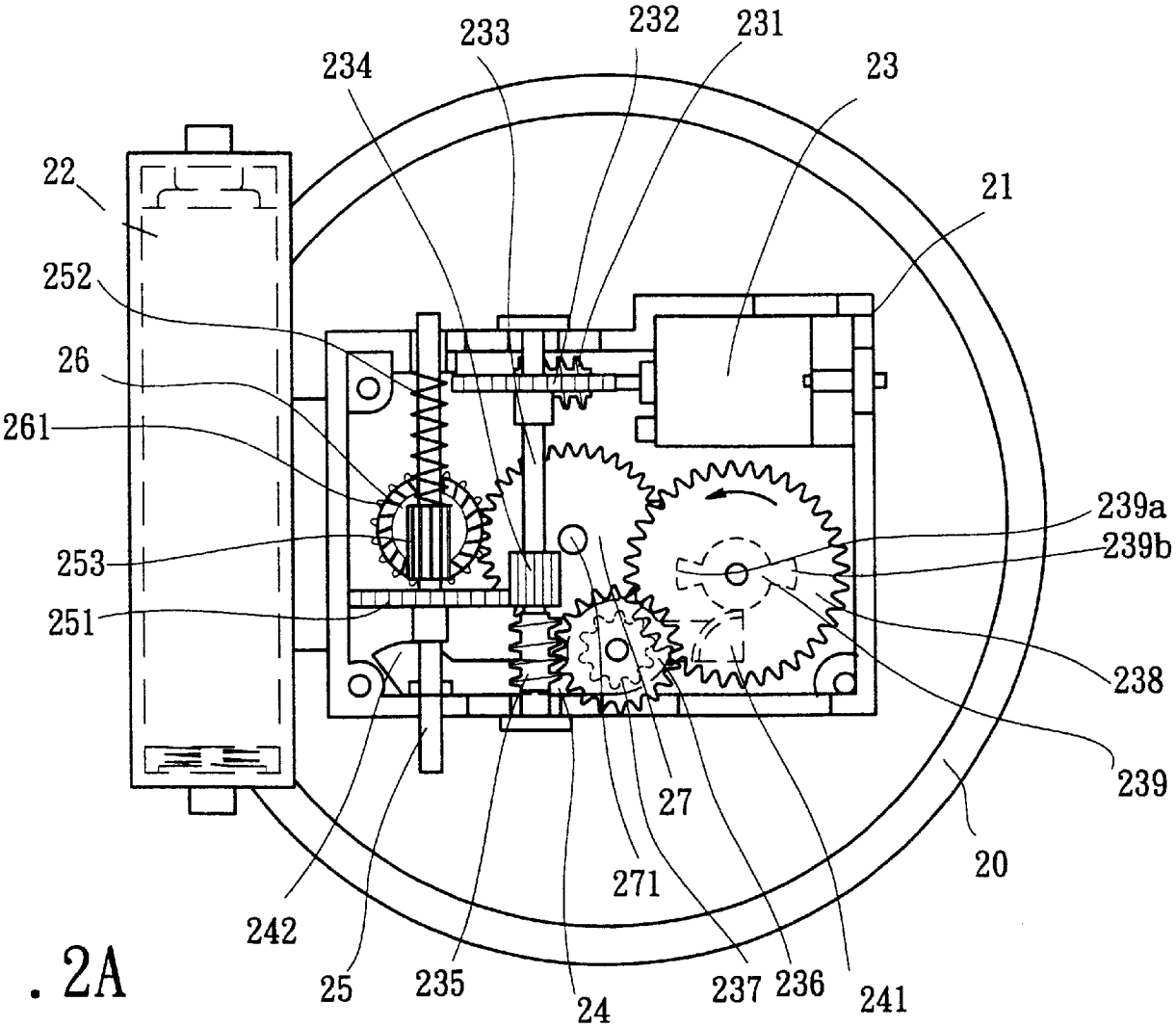
FIG. 2A is a plane view of an embodiment of a cap of the invention under operation.
Figure 2B:
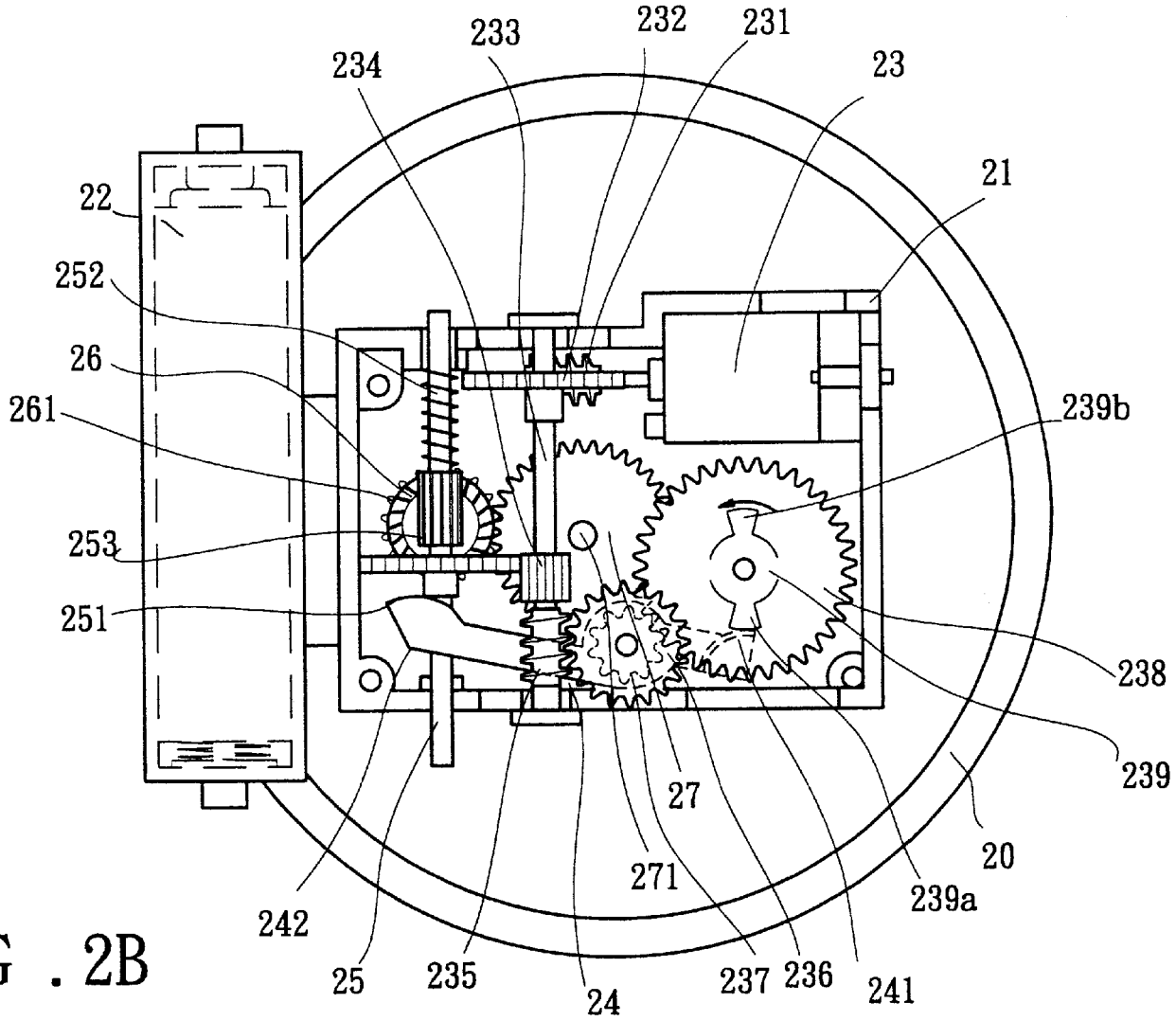
FIG. 2B is another plane view of an embodiment of a cap of the invention under operation.

Referring to FIGS. 1 and 2, the toy according to the invention mainly includes a semispherical base 10, a dish-shaped cap 20 mounted to the top section of the semispherical base 10 and a toy model 30 located above the cap 20.

The base 10 has a hollow interior and an arched slot 11 formed on the top shell wall thereof. The arched slot 11 has one side attached to an arched gear rack 12. Inside the base 10, there is a motor 13 powered by a battery to rotate a driving gear 131 mounted to the motor spindle. The driving gear 131 can transmit rotation power through three sets of driven gears 132 to a movable wheel 133 mounted to a vertical shaft located at a lower section of the base 10. There are also two sets of stationary wheels 134 mounted transversely on a selected location in the base 10. The battery located at the bottom side of the base 10 supplies power to drive the movable wheel 133. The axle of the movable wheel

133 can generate rotation of 360 degrees and drive the stationary wheels 134 rotating to move the base 10 around.

The cap 20 has a top section attached to a hollow casing 21. The casing 21 has one side housing a battery 22 to power a motor 23 located in the casing 21. The motor 23 has a spindle mounting a main worm 231 which is engaged with a worm gear 232 located at an upper section of the casing 21 for rotating the worm shaft 233 of the worm gear 232. The worm shaft 233 then drives a spur gear 234 mounted thereon to rotate. The worm shaft 233 has another end attached to a driven worm 235 which may also be rotated. The driven worm 235 further engages with a small worm gear 236. The small worm gear 236 engages with a pinion 237 located therebeneath for driving a large gear 238. The larger gear 238 attaches to a cam 239 thereunder. The cam 239 has two wings 239*a* and 239*b* located at two sides thereof.

There is a lever 24 which has a center located below the spindle of the small worm gear 236. The lever 24 having a first end 241 contacts the peripheral rim of the cam 239. The spur gear 234 mounted on the worm shaft 233 is engaged with a driven wheel 251 mounted on a transverse rod 25. The driven wheel 251 has a peripheral rim in contact with a second end 242 of the lever 24. The transverse rod 25 has another end coupled with an elastic element 252 and a middle section coupled with a first rotary gear 253. There is a bevel gear 26 vertically located below the first rotary gear 253. The first rotary gear 253 and the bevel gear 26 are engaged for transferring transverse rotation of the first rotary gear 253 to longitudinal rotation of the bevel gear 26. There is further a longitudinal gear 261 located at a lower section of the bevel gear 26. The longitudinal gear 261 further engages with and drives a second rotary gear 27 which has the axis located at the center of the cap 20. The second rotary gear 27 has an axle 271 which has an upper section coupled with a spring 272. The spur gear 234 has a top section to engage with a vertical bevel gear 32 located below the toy model 30 such as a helicopter propeller 31. Hence the propeller 31 of the toy model 30 may be driven and rotated. The axle 271 further has a lower section coupled with a movable gear 273 which is engaged with the arched gear rack 12 below the cap 20 and on the top surface of the base 10. The movable gear 273 may be moved left or right along the arched gear rack 12.

The toy model 30 such as a helicopter has a bottom section mounted to the casing 21. The vertical bevel gear 32 is located below the propeller 31 which has a bottom section fastened to the casing 21 through a fastening element.

By means of the construction set forth above, when the motor 13 in the base 10 is activated for operation, the movable wheel 133 at the bottom section of the base 10 will be rotated and the stationary wheels 134 will also be driven to rotate at the same time, thus the base 10 will be moved around.

When the motor on the cap 20 is activated and rotates, the main worm 231 drives the worm gear 232 and the spur gear 234 coaxial with the worm gear 232, and the driven worm 235 located at another end of the worm shaft 233 will also be rotated synchronously. The driven worm 235 further drives the small worm gear 236 that in turn drives the pinion 237 and large gear 238, and the cam 239 attached to the large gear 238 also will be driven. The wings 239*a* and 239*b* of the cam 239 will trigger and push the first end 241 of the lever 24 to generate movements desired (referring to FIGS. 2A and 2B). The lever 24 has a middle point to function as a fulcrum to allow the second end 242 more inwards. As the second end 242 contacts the outer side of the driven wheel 251 mounted on the transverse rod 25, the inward moving second end 242 will push the transverse rod 25 towards the elastic element 252 and the elastic element 252 will be compressed against the inner wall of the casing 21. On the other hand, the driven wheel 251 on the transverse rod 25 is engaged with the right side of the spur gear 234 mounted on the worm shaft 233. Thus the driven wheel 251 will be driven and rotated. And the first rotary gear 253 on the transverse rod 25 will also be pushed towards the elastic element 252 to engage with the right side of the bevel gear 26 located below to allow the bevel gear 26 generate rotation in the positive direction. The second rotary gear 27 engaged with the longitudinal gear 261 located at the lower section of the bevel gear 26 will generate rotation in a reverse direction.

When the smaller peripheral rim of the cam 239 touches the first end 241 of the lever 24, the second end 242 of the lever 24 will be pushed back by the elastic element 252, and the driven wheel 251 on the transverse rod 25 will be moved and engaged with the left side of the spur gear 234, and the first rotary gear 253 will be moved to its original position on the left hand side and is located on the left hand side of the bevel gear 26. As a result, the first rotary gear 253 drives the bevel gear 26 to rotate in the reverse direction. By the same token, the second rotary gear 27 engaged with the longitudinal gear 261 at the lower section of the bevel gear 26 will be rotated in the positive direction. Hence the cap 20 will be turned positively and reversely alternatively.

Figure 3:
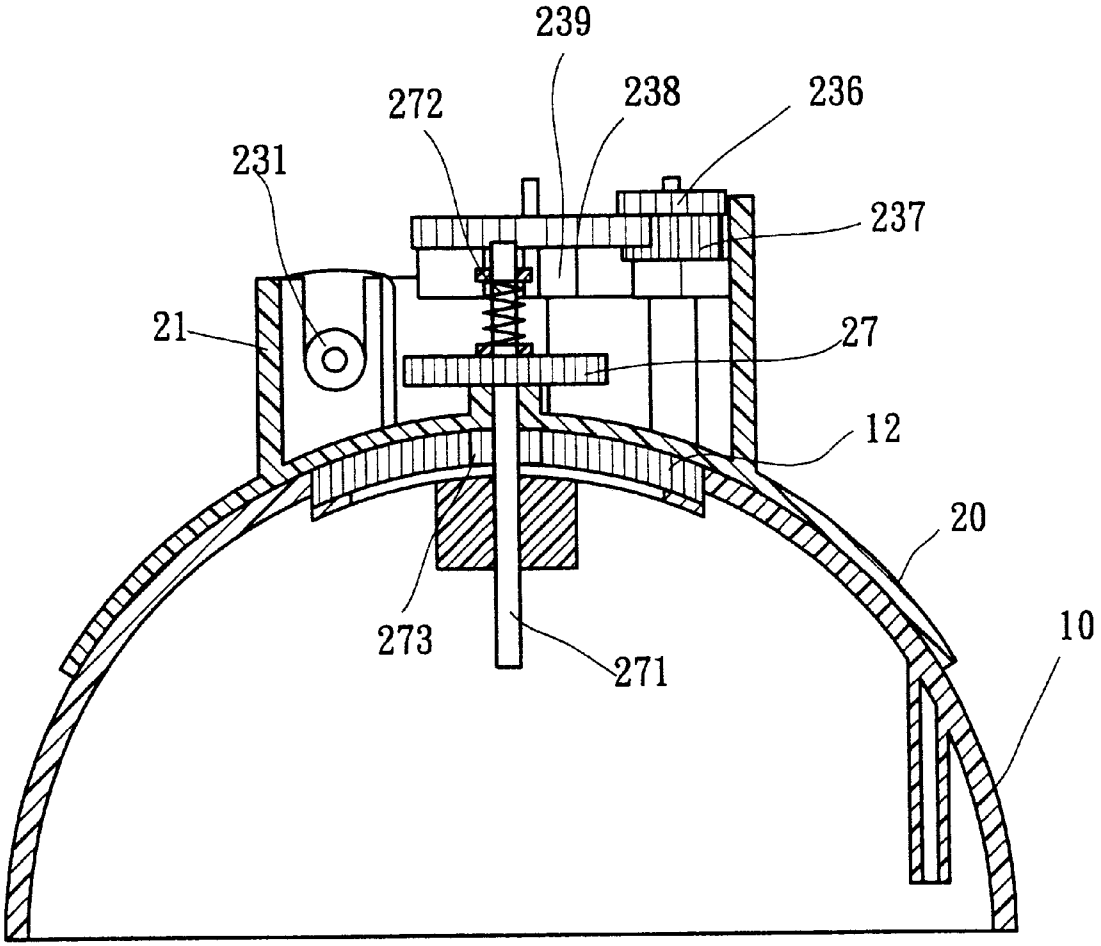
FIG. 3 is a schematic cross section of an embodiment of a base of the invention.
Figure 4:
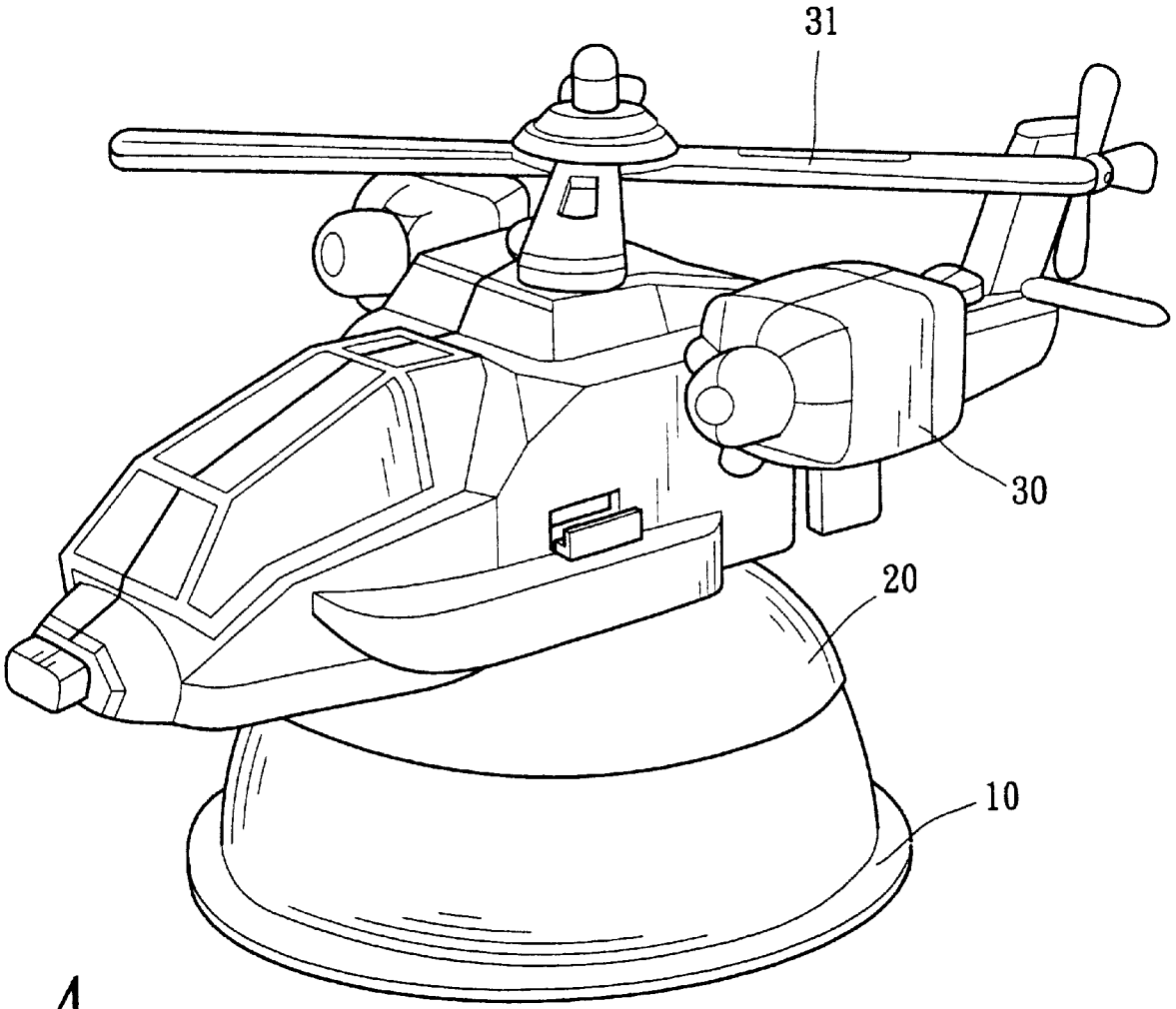
FIG. 4 is a perspective view of an embodiment of the invention.
Figure 5:
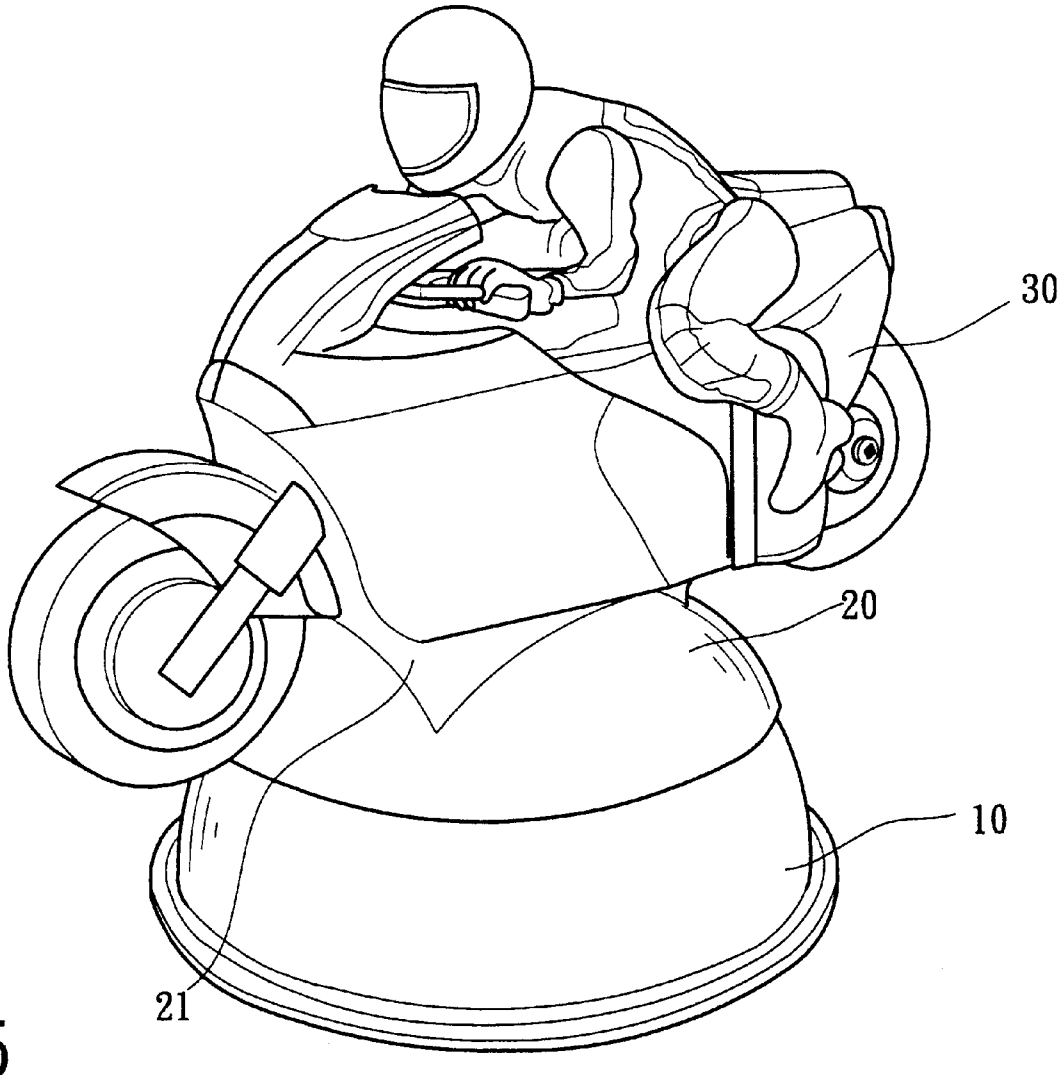
FIG. 5 is a perspective view of an embodiment of the invention mocking a motorcycle.

Referring to FIG. 3, the movable gear 273 located at the lower section of the axle 271 of the second rotary gear 27 is movable along the arched gear rack 12 of the base 10. When the moving displacement reaches the left or right end, the two wings 239*a* and 239*b* of the cam 239 contact the first end 241 of the lever 24. As the wings 239*a* and 239*b* have respectively a selected arch length, the movable gear 273 is stopped from moving forwards or backwards, and is anchored in a stationary manner. As a result, the second rotary gear 27 mounted to the cap 20 turns reversely because of the spindle 271 is not moving. Hence the cap 20 is moved towards the left and right along the arched gear rack 12, and the vertical bevel gear 32 located below the toy model 30 such as the helicopter propeller 31 is driven by the spur gear 234 and rotates. In the mean time, the cap 20 will be moved to the left or right side of the base 10 and generates positive and reverse rotations. The travel and return cycle of the cap depends on the arch length of the wings 239*a* and 239*b* of the cam 239. By means of the invention, the toy can move around on the floor, and the cap 20 can also move the toy model 30 to the left and right and rotate in the positive and reverse directions. The cap 20 further can move reciprocally along the arched surface of the base 10 in the left and right direction to generate a wide variety of motion in various directions and angles to simulate real fly or ride postures, thereby resulting in a greater appeal to consumers. The toy model 30 may be mocked to any object desired other than the helicopter, such as a motorcycle shown in FIG. 5.

What is claimed is:

1. A toy, comprising:

a semispherical base having an arched slot formed on a top side thereof, the arched slot having one side attached to an arched gear rack;

a cap movably located on the top side of the base having a top section attached to a hollow casing, the casing housing a battery to power a motor located in the casing, the motor having a spindle which has one end mounted on a main worm for transmitting power to rotate a transverse worm gear and a worm shaft of the worm gear, the worm shaft being coupled with a spur gear which is engaged with a driven wheel mounted on a transverse rod in parallel with the worm shaft, the worm shaft having one end attached to a driven worm for driving a longitudinal small worm gear, the small worm gear being coupled with a pinion therebeneath to drive a large gear and a cam located beneath the large gear to rotate, the cam having two wings formed at two sides thereof and a peripheral rim in contact with a first end of a lever, the lever having a second end in contact with an outer side of a driven wheel mounted to the transverse rod, the transverse rod further being coupled with a first rotary gear which is engaged with a bevel gear located below the first rotary gear at a left or right side of the bevel gear for controlling the bevel gear to rotate positively or reversely, the transverse rod also being coupled with an elastic element, the bevel gear having a lower section attached to a longitudinal gear for driving a second rotary gear mounted on a center axle of the cap, the second rotary gear having a spindle which has a lower section mounted on a movable gear which is movable along the arched gear rack of the base; and a toy model fastened to a top section of the casing of the cap.

2. The toy of claim 1, wherein the base has a bottom section which is pivotally engaged with a vertical shaft for coupling a movable wheel, and two stationary wheels which are transversely mounted to the bottom section at selected locations, the movable wheel and the stationary wheels being driven through a gear set by a motor which is connected to a battery for moving the base around.

3. The toy of claim 1, wherein the spur gear mounted to the worm shaft is engageable with a vertical bevel gear located below a propeller of a toy helicopter.

* * * * *